US008331810B2

(12) United States Patent
Murauchi et al.

(10) Patent No.: US 8,331,810 B2
(45) Date of Patent: Dec. 11, 2012

(54) DEVELOPING APPARATUS AND IMAGE FORMING MACHINE

(75) Inventors: Junji Murauchi, Toyokawa (JP); Tomohiro Kato, Okazaki (JP); Megumi Minami, Amagasaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 622 days.

(21) Appl. No.: 12/469,177

(22) Filed: May 20, 2009

(65) Prior Publication Data

US 2009/0290887 A1 Nov. 26, 2009

(30) Foreign Application Priority Data

May 21, 2008 (JP) ..... 2008-133023

(51) Int. Cl.
*G03G 15/08* (2006.01)

(52) U.S. Cl. ..... 399/27

(58) Field of Classification Search ..... 399/24, 399/27, 257, 260, 264
See application file for complete search history.

(56) References Cited

U.S. PATENT DOCUMENTS

| | | | | |
|---|---|---|---|---|
| 5,548,385 | A | 8/1996 | Takai et al. | |
| 7,346,286 | B2 * | 3/2008 | Matsumoto et al. | 399/29 |
| 7,383,002 | B2 * | 6/2008 | Murata et al. | 399/257 |
| 7,783,232 | B2 * | 8/2010 | Minami et al. | 399/255 |
| 2008/0279592 | A1 * | 11/2008 | Matsumoto et al. | 399/259 |
| 2009/0110422 | A1 * | 4/2009 | Shinichi | 399/55 |

FOREIGN PATENT DOCUMENTS

| | | |
|---|---|---|
| JP | 59-100471 A | 6/1984 |
| JP | 06-348134 | 12/1994 |
| JP | 10-048932 | 2/1998 |
| JP | 11-119531 | 4/1999 |
| JP | 2007-052213 | 3/2007 |
| JP | 2007-156355 | 6/2007 |

OTHER PUBLICATIONS

Notification of Reason for Refusal issued in the corresponding Japanese Patent Application No. 2008-133023 dated Mar. 23, 2010, and an English translation thereof.

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

The present invention provides a developing apparatus capable of predicting how much carrier is accumulated inside a developer tank beyond the discharge level of a trickle discharging mechanism in the case that images having high coverage ratios are printed out continuously in a trickle developing apparatus that uses a two-component developer. The developing apparatus, having stirring members for conveying and stirring a developer-tank-contained developer and a developer holder, comprises a developer replenishing tank; a discharging mechanism for discharging an excessive amount of the developer-tank-contained developer outside the developer tank when the amount of the developer-tank-contained developer inside the developer tank has exceeded a predetermined amount; and calculating device for calculating the amount of the carrier existing inside the developer tank, and judges using the calculating device that the integrated value of carrier obtained by integrating the amount of the carrier existing inside the developer tank is likely to exceed a predetermined excessive accommodation amount of carrier.

20 Claims, 5 Drawing Sheets

DEVELOPING APPARATUS AND IMAGE FORMING MACHINE

This application is based on the application No. 2008-133023 filed in Japan, the content of which is hereby incorporated by reference.

BACKGROUND OF THE INVENTION

1. Field of the Invention

The present invention relates to a developing apparatus for use in an electrophotographic image forming machine and to an image forming machine incorporating the developing apparatus. More particularly, the present invention relates to a trickle developing apparatus that gradually supplies fresh developer and gradually discharge deteriorated developer and to an image forming machine incorporating the developing apparatus.

2. Description of the Related Art

As developing systems employed for electrophotographic image forming machines, the one-component developing system in which toner is used as the main component of the developer and the two-component developing system in which toner and carrier are used as the main components of the developer are known.

The two-component developing system that uses toner and carrier, in which the toner and carrier are charged by friction contact therebetween to predetermined polarities, has a characteristic that the stress on the toner is less than that in the one-component developing system that uses a one-component developer. Since the surface area of the carrier is larger than that of the toner, the carrier is less contaminated with the toner attached to the surface thereof. However, with the use for a long period, contamination (spent) attached to the surface of the carrier increases, whereby the capability of charging the toner is reduced gradually. As a result, problems of photographic fog and toner scattering occur. Although it is conceivable that the amount of the carrier stored in a two-component developing apparatus is increased to extend the life of the developing apparatus, this is undesirable because the developing apparatus becomes larger in size.

To solve the problems encountered in the two-component developer, Patent document 1 discloses a trickle developing apparatus being characterized in that fresh developer is gradually replenished into the developing apparatus and developer deteriorated in charging capability is gradually discharged from the developing apparatus, whereby the increase of the deteriorated carrier is suppressed. The developing apparatus is configured to maintain the volume level of the developer inside the developing apparatus approximately constant by discharging an excessive amount of deteriorated developer using the change in the volume of the developer. In the trickle developing apparatus, the deteriorated carrier inside the developing apparatus is gradually replaced with fresh carrier, and the charging performance of the carrier inside the developing apparatus can be maintained approximately constant.

[Patent document 1] Japanese Patent Application Laid-Open Publication No. Sho 59-100471

However, when an image having a high coverage ratio, such as a photographic image, is printed in the above-mentioned trickle developing apparatus, toner inside the developing apparatus is consumed abundantly to form an image having a high coverage ratio. Although toner is replenished into the developing apparatus by replenishing fresh developer containing toner and carrier to compensate for the toner consumed abundantly, the carrier replenished simultaneously with the toner is not consumed but remains inside the developing apparatus.

If images having high coverage ratios are printed out continuously, the accumulated amount of carrier inside the developing apparatus increases, the volume level of the developer inside the developing apparatus rises gradually. When the volume level reaches the discharge level of a trickle discharging mechanism, the developer is discharged using the trickle discharging mechanism. If the discharging amount is set higher so as to print out images having high coverage ratios, when images having ordinary coverage ratios are printed out, the discharging amount using the trickle discharging mechanism increases and the developer inside the developing apparatus is used wastefully. For this reason, the discharging amount using the trickle discharging mechanism is usually set lower so as to print out images having low coverage ratios. Accordingly, if images having high coverage ratios are printed out continuously, when the amount discharged using the trickle discharging mechanism is small, developer discharge is not carried out sufficiently.

The developer not discharged sufficiently using the trickle discharging mechanism is accumulated inside the developing apparatus beyond the discharge level of the trickle discharging mechanism. If the level of the developer exceeds an overflow level, that is, a regulating gap between the sleeve of a developing roller and a regulating plate opposed to the sleeve, the developer overflows over the regulating gap, thereby damaging the image forming machine.

It is technically possible to use detecting means, such as a level sensor (for example, a pressure sensor), to detect the volume level of the developer existing inside the developer tank. However, in that case, there occurs a problem that the configuration becomes complicated or the cost becomes high.

Accordingly, in the case that images having high coverage ratios are printed out continuously in a trickle developing apparatus that uses a two-component developer, the technical problem to be solved by the present invention is to provide a developing apparatus and an image forming machine capable of predicting how much carrier is accumulated inside the developer tank beyond the discharge level of the trickle discharging mechanism.

SUMMARY OF THE INVENTION

To solve the above-mentioned technical problem, the present invention provides a developing apparatus having stirring members for stirring a developer-tank-contained developer containing toner and carrier inside a developer tank while conveying the developer and a developer holder disposed adjacent to the stirring members to supply the stirred developer-tank-contained developer to an electrostatic latent image holder, comprising:

a developer replenishing tank for replenishing the toner and the carrier to the developer tank, a discharging mechanism provided in the developer tank to discharge an excessive amount of the developer-tank-contained developer outside the developer tank when the amount of the developer-tank-contained developer inside the developer tank has exceeded a predetermined amount, and calculating device for calculating the amount of the carrier existing inside the developer tank, wherein the calculating device judges whether the integrated value of carrier obtained by integrating the carrier existing inside the developer tank is likely to exceed a predetermined excessive accommodation amount of carrier.

In the present invention, in the case that images having high coverage ratios are printed out continuously in a trickle developing apparatus that uses a two-component developer, replenishment operation is carried out to compensate for toner consumed abundantly. The present invention focuses on the fact that carrier is accumulated gradually inside the developer tank by the replenishment operation for the developer, and the accumulated carrier causes trouble.

With the above-mentioned developing apparatus, it is judged using the calculating device whether the integrated value of carrier obtained by integrating the amount of the carrier existing inside the developer tank is likely to exceed the predetermined excessive accommodation amount of carrier. The predetermined excessive accommodation amount of carrier is herein a design value uniquely determined on the basis of the structure of the developing apparatus and is defined as the amount of carrier contained in the developer that is accommodated excessively inside the developer tank. The excessively accommodated amount of carrier is obtained by subtracting the full charging amount of the developer-tank-contained developer at which the developer fills the developer tank to the level immediately before the developer is discharged using the discharging mechanism from the overflow limit amount immediately before the developer-tank-contained developer overflows over the regulating gap of the developer tank. With the above-mentioned configuration, it is possible to predict how much carrier is accumulated inside the developer tank beyond the discharge level of the trickle discharging mechanism without using any detecting means, such as a level sensor (for example, a pressure sensor), for detecting the volume level of the developer-tank-contained developer. The configuration is thus advantageous for its very simple structure and low cost.

In the case that it is defined that the replenishment amount of carrier to be replenished from the developer replenishing tank per predetermined time is Cin and that the maximum discharge amount of carrier to be discharged to the maximum extent using the discharging mechanism per predetermined time is Cmax, the calculating device calculates the remaining amount of carrier (Cin−Cmax) remaining inside the developer tank per predetermined time and calculates the integrated value of carrier by integrating the calculated remaining amount of carrier (Cin−Cmax). The integrated value of carrier is a value obtained by integrating the amount of carrier remaining inside the developer tank, that is, the remaining amount of carrier (Cin−Cmax), and is used to predict how much carrier is accumulated inside the developer tank beyond the discharge level of the so-called trickle discharging mechanism.

The replenishment amount of carrier is calculated on the basis of toner concentration.

Or, the replenishment amount of carrier is calculated on the basis of coverage ratio.

In the case that it has been judged using the calculating device that the integrated value of carrier is likely to exceed the predetermined excessive accommodation amount of carrier, the replenishment of toner and carrier to the developer tank is stopped.

The replenishment of the replenishment developer is stopped until it is judged using the calculating device that the integrated value of carrier is less than the excessive accommodation amount of carrier.

The above-mentioned developing apparatus is incorporated and used in an image forming machine comprising a rotatable electrostatic latent image holder for holding electrostatic latent images on the circumferential face thereof, stirring members for stirring a developer-tank-contained developer containing toner and carrier inside a developer tank while conveying the developer, and a developer holder disposed adjacent to the stirring members to supply the stirred developer-tank-contained developer to the electrostatic latent image holder.

BRIEF DESCRIPTION OF THE DRAWINGS

FIG. 4(A) relates to replenishment operation, FIG. 4(B) relates to discharging operation, and FIG. 4(C) relates to integrating operation.

DESCRIPTION OF THE PREFERRED EMBODIMENT

Figure 1:
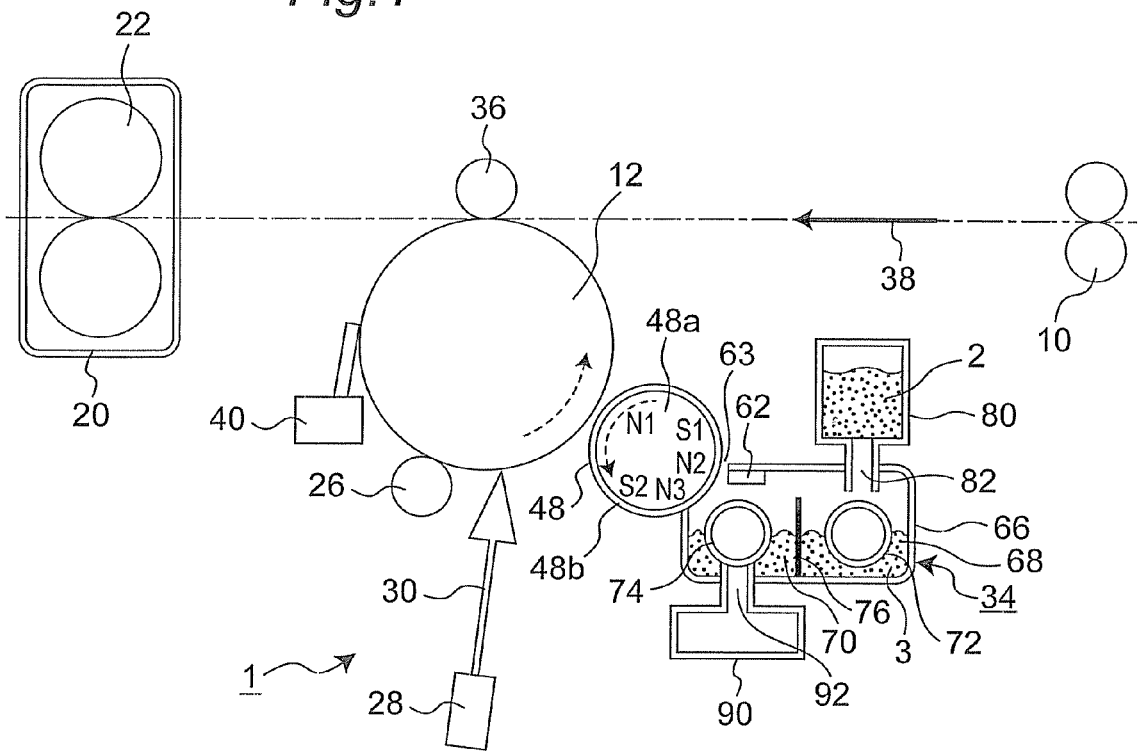
FIG. 1 is a view showing the schematic configuration of an image forming machine according to a first embodiment of the present invention.

Preferred embodiments according to the present invention will be described below referring to the accompanying drawings. Although terms meaning specific directions (for example, "above," "below," "left" and "right" and other terms including these, and "clockwise" and "counterclockwise") are used in the following description, they are used for purposes of facilitating the understanding of the present invention referring to the drawings, and it should not be construed that the present invention is limited by the meanings of the terms. Furthermore, in an image forming machine 1 and a developing apparatus 34 described below, identical or similar components are designated by the same reference numerals.

The image forming machine 1 and the developing apparatus 34 incorporated therein according to a first embodiment of the present invention will be described referring to FIGS. 1 to 3.

[Image Forming Machine]

FIG. 1 shows the components relating to image formation in the electrophotographic image forming machine 1 according to the present invention. The image forming machine 1 may be a copier, a printer, a facsimile machine or a compound machine combinedly equipped with the functions of these. The image forming machine 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing apparatus 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing apparatus 34 develops the electrostatic latent image into a visible image using a developer-tank-contained developer 3 described later. The details of the developing apparatus 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 1, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming machine 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing apparatus 34 and developed into a visible image using the developing apparatus 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

[Developing Apparatus]

The developing apparatus 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap 63 therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 1 (counter direction).

Figure 2:
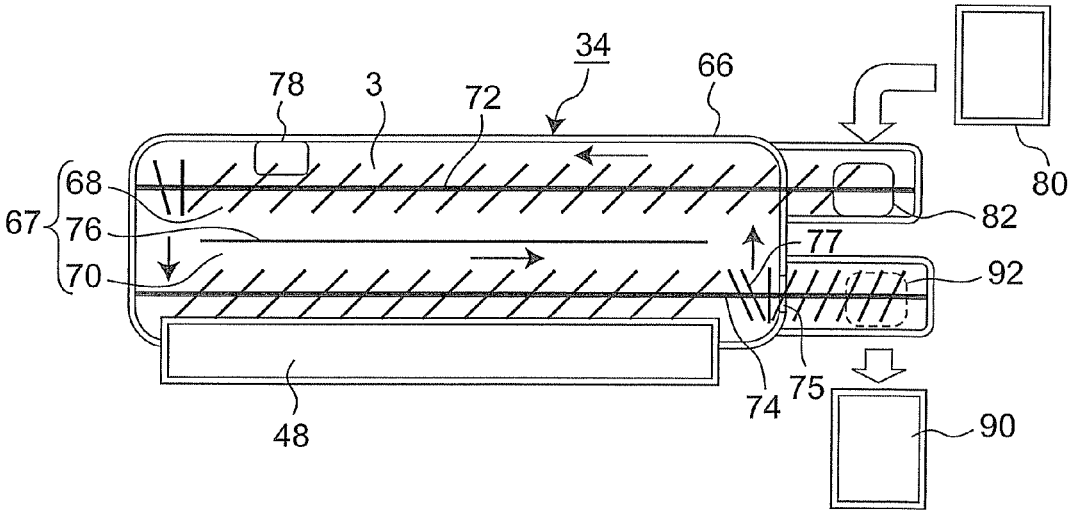
FIG. 2 is a schematic sectional view showing the developing apparatus of the image forming machine shown in FIG. 1 as seen from above.

FIG. 2 is a schematic sectional view showing the developing apparatus 34 as seen from above. As shown in FIG. 2, a developer stirring and conveying chamber 67 is formed behind the developing roller 48. The developer stirring and conveying chamber 67 comprises a second conveying passage 70 formed near the developing roller 48, a first conveying passage 68 formed away from the developing roller 48 and a partition wall 76 for partitioning the space between the first conveying passage 68 and the second conveying passage 70. Above the upstream side of the conveying direction of the first conveying passage 68, a developer replenishing tank 80 is disposed and communicates with the first conveying passage 68 via a replenishing port 82. The developer replenishing tank 80 is filled with a replenishment developer 2 containing toner as a major ingredient and carrier. The toner and the carrier may be replenished separately as the replenishment developer 2. The ratio of the carrier in the replenishment developer 2 is preferably 5 to 40 wt %, further preferably 10 to 30 wt %. In addition, below the downstream side of the conveying direction of the second conveying passage 70, a developer recovery tank 90 is disposed and communicates with the second conveying passage 70 via a recovery port 92.

At the bottom of the developer replenishing tank 80, a developer supplying roller is disposed, the driving operation of which is controlled using a controller 100. When the developer supplying roller is driven and rotated, the replenishment developer 2, which is fresh and the amount of which corresponds to the driving time of the roller, flows downward and is supplied to the first conveying passage 68 of the developer tank 66.

In the first conveying passage 68, a first screw 72 serving as a stirring member for conveying the developer-tank-contained developer 3 while stirring the developer is rotatably supported. In the second conveying passage 70, a second screw 74 for conveying the developer-tank-contained developer 3 from the first conveying passage 68 to the developing roller 48 while stirring the developer is rotatably supported. In this case, the upper portions of the partition wall 76 located at both end sections of the first conveying passage 68 and the second conveying passage 70 are cut out, and communicating passages are formed. The developer-tank-contained developer 3 having reached the end section on the downstream side in the conveying direction of the first conveying passage 68 is sent into the second conveying passage 70 via the communicating passage, and the developer-tank-contained developer 3 having reached the end section on the downstream side in the conveying direction of the second conveying passage 70 is sent into the first conveying passage 68 via the communicating passage. As a result, the developer-tank-contained developer 3 is circulated inside the developer stirring and conveying chamber in the direction indicated by the arrows shown in FIG. 2.

The first screw 72 and the second screw 74 are each a spiral screw in which a spiral vane with a predetermined pitch is secured to a rotating shaft. The second screw 74 is extended rightward (to the downstream side) in FIG. 2 and further extended above the recovery port 92. At each of the positions corresponding to the communicating passage from the second conveying passage 70 to the first conveying passage 68 and to the downstream side end section of the first conveying passage 68, the second screw 74 has a reverse vane section 77 in which the spiral direction of the spiral screw is opposite to that at the other section. The pitch of the vane of the second screw 74 at the downstream side end section (the right end section in FIG. 2) in the conveying direction is made smaller than that at the other section. As a result, when the second screw 74 is rotated, the level of the developer-tank-contained developer 3 at the downstream side end section (the right end section) in the conveying direction of the second screw 74 becomes higher than that at the other vane section. In other words, a rising of the developer-tank-contained developer 3 is formed at the downstream side end section (the right end section) in the conveying direction of the second screw 74.

Since the developing apparatus 34 employs the so-called trickle system, the developing apparatus has an outlet 75 for allowing an excessive amount of the developer-tank-contained developer 3 to flow out. In other words, the outlet 75 is formed by providing a cutout 75 that is formed by partially cutting out the upper portion of the side wall located at the downstream side end section (the right end section) in the conveying direction of the second conveying passage 70. In a usual state, the developer being conveyed using the second screw 74 is stopped using the reverse vane section 77 and conveyed from the second conveying passage 70 to the first conveying passage 68 as indicated by the solid-line arrows shown in FIG. 2. When the developer-tank-contained developer 3 increases inside the developer tank and the developer level inside the developer tank rises, the developer-tank-contained developer 3 climbs over the outlet 75 disposed at the upper portion of the side wall against the stopping action of the reverse vane section 77 and overflows to a recovery chamber adjacent thereto. The excessive amount of the developer-tank-contained developer 3 overflowed to the recovery chamber is conveyed to the recovery port 92 and recovered (dumped) into the developer recovery tank 90 via the recovery port 92.

In the developer stirring and conveying chamber 67, a toner concentration detecting sensor 78 for detecting the current toner concentration inside the developer stirring and conveying chamber 67 is provided. The toner concentration detecting sensor 78 detects the permeability of the developer-tank-contained developer 3 being conveyed inside the developer stirring and conveying chamber 67 on the basis of the change in the inductance of a coil, for example. The ratio of the toner in the developer-tank-contained developer 3 is obtained on the basis of the permeability detected using the toner concentration detecting sensor 78. For example, when the amount of the carrier contained in the developer-tank-contained developer 3 is small, it is detected that the ratio of the toner is high. On the other hand, when the amount of the carrier contained in the developer-tank-contained developer 3 is large, it is detected that the ratio of the toner is low. In addition, the voltage signal output from the toner concentration detecting sensor 78 is input to the controller 100, a required replenishing amount is calculated on the basis of the detection signal, the developer replenishing roller of the developer replenishing tank 80 is driven, and the predetermined amount of the replenishment developer 2 is replenished into the developer tank 66.

In the developing apparatus 34, when the toner concentration of the developer-tank-contained developer 3 lowers as the printing operation proceeds, the replenishment developer 2 containing toner and a small amount of carrier is replenished from the developer replenishing tank 80. The replenishment developer 2 having been replenished is conveyed along the first conveying passage 68 and the second conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing apparatus 34, and the charging performance of the carrier lowers gradually. Since a small amount of the carrier that is bulkier than the toner is contained in the replenishment developer 2, as the replenishment developer 2 is replenished, the amount of the developer-tank-contained developer 3 gradually increases inside the developing apparatus 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse vane section 77 and flows out from the outlet 75 provided at the downstream side end section (the right end section) in the conveying direction of the second conveying passage 70 and is recovered in the developer recovery tank 90 via the recovery port 92.

The replenishing amount of the replenishment developer 2 is determined on the basis of the current toner concentration of the developer-tank-contained developer 3 detected using the toner concentration detecting sensor 78 or the coverage ratio (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing apparatus 34 is suppressed from deteriorating and that the cost is not increased. As the toner replenishing operation proceeds, the carrier is supplied gradually.

Figure 3:
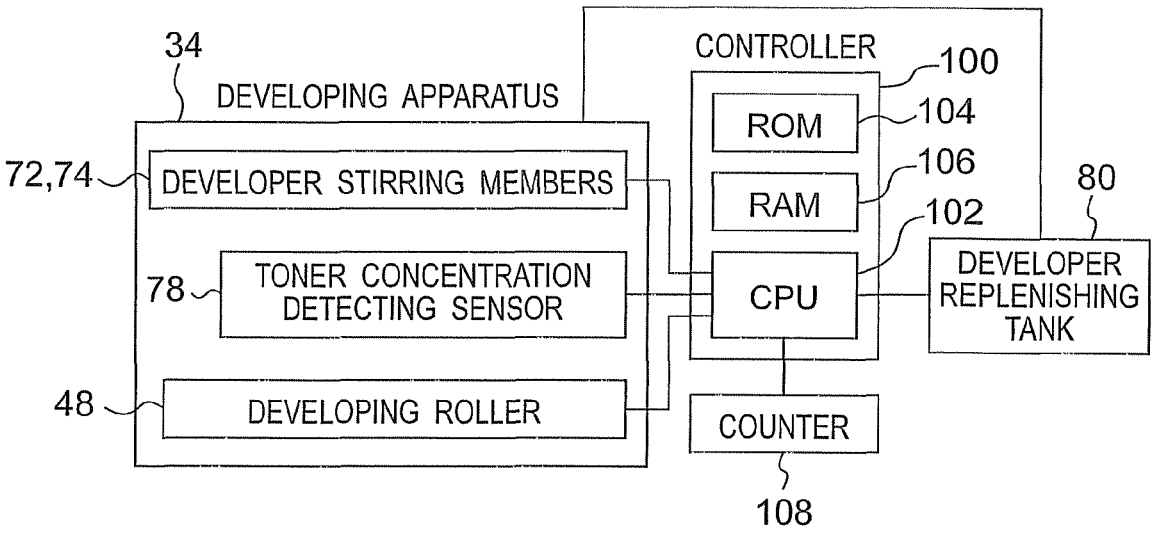
FIG. 3 is a block diagram of the developing apparatus of the image forming machine shown in FIG. 2.

FIG. 3 is a control block diagram of the developing apparatus 34 of the image forming machine 1.

The controller 100 serving as controlling means comprises a CPU (central processing unit) 102, a ROM (read only memory) 104, a RAM (random access memory) 106, etc. The CPU 102 concentratedly controls various operations in the image forming machine 1 according to various processing programs and tables stored inside the ROM 104. For example, a toner concentration calculation table for carrying out calculation to convert the voltage detected using the toner concentration detecting sensor 78 into the current toner concentration of the developer-tank-contained developer 3 and a, developer replenishing table for calculating the amount of the developer to be replenished on the basis of the difference in toner concentration between the current toner concentration of the developer-tank-contained developer 3 and a reference toner concentration are stored in the ROM 104.

Furthermore, the RAM 106 provides a work area in which various programs to be executed by the controller 100 and data for the programs are temporarily stored.

The developing apparatus 34, the developer replenishing tank 80 and a counter 108 are connected to the CPU 102. The operations of the developer stirring members 72 and 74, the toner concentration detecting sensor 78 and the developing roller 48 constituting the developing apparatus 34 and the replenishment control operation for the replenishment developer 2 are respectively controlled using the CPU 102 of the controller 100. More specifically, the CPU 102 has functions serving as calculating device for calculating the replenishment amount of carrier (Cin), the remaining amount of carrier (Cin−Cmax), the integrated value of carrier (S), etc., judging means for judging whether the toner concentration, the integrated value of carrier (S), etc. have reached predetermined values, and controlling means for controlling the replenishment operation, the image forming operation, the scanning operation of the scanner, etc.

In addition, the current toner concentration of the developer-tank-contained developer 3 detected using the toner concentration detecting sensor 78, the coverage ratio (image information) at the time of image formation, the replenishment amount of carrier (Cin), the remaining amount of carrier (Cin−Cmax), the integrated value of carrier (S), the ratio of the carrier in the replenishment developer 2 inside the developer replenishing tank 80, the coverage ratio, etc. are temporarily stored in the RAM 106.

The coverage ratio is herein defined as the ratio of the area of a portion on which toner is deposited when it is assumed that the ratio of the total area constituting an image is 100% and, in other words, a value relating to the amount of deposited toner at the time of image formation.

[Developer]

The two-component developer contains toner and carrier for charging the toner. In the present invention, the known toner that has been used generally and conventionally can be used for the image forming machine 1. The particle diameter of the toner is, for example, approximately 3 to 15 μm. It is also possible to use toner containing a coloring agent in a binder resin, toner containing a charge control agent and a releasing agent, and toner holding additives on the surface.

The toner is produced using known methods, such as the grinding method, the emulsion polymerization method and the suspension polymerization method.

Examples of the binder resin being used for the toner include styrene resins (homopolymers or copolymers containing styrene or styrene substitutes), polyester resins, epoxy resins, polyvinyl chloride resins, phenol resins, polyethylene resins, polypropylene resins, polyurethane resins, silicone resins or any appropriate combinations of these resins, although not restricted to these. The softening temperature of the binder resin is preferably in the range of approximately 80 to 160° C., and the glass transition temperature thereof is preferably in the range of approximately 50 to 75° C.

As the coloring agent, it is possible to use known materials, such as carbon black, aniline black, activated charcoal, magnetite, benzine yellow, permanent yellow, naphthol yellow, phthalocyanine blue, fast sky blue, ultramarine blue, rose bengal and lake red. In general, the additive amount of the coloring agent is preferably 2 to 20 parts by weight per 100 parts by weight of the binder resin.

The materials conventionally known as charge control agents can be used as the charging control agent. More specifically, for the toner that is positively charged, it is possible to use materials, such as nigrosin dyes, quaternary ammonium salt compounds, triphenylmethane compounds, imidazole compounds and polyamine resins, as the charge control agent. For the toner that is negatively charged, it is possible to use materials, such as azo dyes containing metals such as Cr, Co, Al and Fe, salicylic acid metal compounds, alkyl salicylic acid metal compounds and calixarene compounds, as the charge control agent. It is desirable that the charge control agent is used in the ratio of 0.1 to 10 parts by weight per 100 parts by weight of the binder resin.

The materials conventionally known and used as releasing agents can be used as the releasing agent. As the material of the releasing agent, it is possible to use materials, such as polyethylene, polypropylene, carnauba wax, sasol wax or any appropriate combinations of these. It is desirable that the releasing agent is used in the ratio of 0.1 to 10 parts by weight per 100 parts by weight of the binder resin.

Furthermore, it may be possible to add a fluidizer for accelerating the fluidization of the developer. As the fluidizer, it is possible to use inorganic particles, such as silica, titanium oxide and aluminum oxide, and resin particles, such as acrylic resins, styrene resins, silicone resins and fluororesins. It is particularly desirable to use materials hydrophobized using a silane coupling agent, a titanium coupling agent, silicone oil, etc. It is desirable that the fluidizer is added in the ratio of 0.1 to 5 parts by weight per 100 parts by weight of the toner. It is desirable that the number average primary particle diameters of these additives are in the range of 9 to 100 nm.

As the carrier, the known carriers used conventionally and generally can be used. Either the binder-type carrier or the coated-type carrier may be used. It is desirable that the diameter of the carrier particles is in the range of approximately 15 to 100 μm, although not restricted to this range.

The binder-type carrier is that obtained by dispersing magnetic particles in a binder resin and it is possible to use carrier having positively or negatively charged particles or a coating layer on its surface. The charging characteristics, such as polarity, of the binder-type carrier can be controlled depending on the material of the binder resin, electrostatic charging particles and the kind of the surface coating layer.

Examples of the binder resin being used for the binder-type carrier include thermoplastic resins, such as vinyl resins typified by polystyrene resins, polyester resins, nylon resins and polyolefin resins, and thermosetting resins, such as phenol resins.

As the magnetic particles of the binder-type carrier, it is possible to use spinel ferrites, such as magnetite and gamma ferric oxide; spinel ferrites containing one or more kinds of nonferrous metals (such as Mn, Ni, Mg and Cu); magnetoplumbite ferrites, such as barium ferrite; and iron or alloy particles having oxide layers on the surfaces. The shape of the carrier may be particulate, spherical or needle-like. In particular, when high magnetization is required, it is desirable to use iron-based ferromagnetic particles. In consideration of chemical stability, it is desirable to use ferromagnetic particles of spinel ferrites, such as magnetite and gamma ferric oxide, or magnetoplumbite ferrites, such as barium ferrite. It is possible to obtain magnetic resin carrier having the desired magnetization by appropriately selecting the kind and content of the ferromagnetic particles. It is appropriate to add 50 to 90 wt % of the magnetic particles to the magnetic resin carrier.

As the surface coating material of the binder-type carrier, it is possible to use silicone resins, acrylic resins, epoxy resins, fluororesins, etc. The charging capability of the carrier can be enhanced by coating the surface of the carrier with this kind of resin and by thermosetting the resin.

The fixation of electrostatic charging particles or electrically conductive particles to the surface of the binder-type carrier is carried out according to, for example, a method in which the magnetic resin carrier is uniformly mixed with the particles, the particles are attached to the surface of the magnetic resin carrier, and then mechanical and thermal impact forces are applied to the particles to put the particles into the magnetic resin carrier. In this case, the particles are not completely embedded into the magnetic resin carrier but fixed such that parts thereof protrude from the surface of the magnetic resin carrier. As the electrostatic charging particles, organic or inorganic insulating materials are used. More specifically, as organic insulating materials, organic insulating particles, such as polystyrene, styrene copolymers, acrylic resins, various acrylic copolymers, nylon, polyethylene, polypropylene, fluororesins and cross-linked materials of these are available. The charging capability and the charging polarity thereof can be adjusted so as to be suited for the material of the electrostatic charging particles, polymerization catalyst, surface treatment, etc. As the inorganic insulating material, negatively charged inorganic particles, such as silica and titanium dioxide, and positively charged inorganic particles, such as strontium titanate and alumina, are used.

The coated-type carrier is carrier obtained by coating carrier core particles made of a magnetic substance with a resin, and electrostatic charging particles charged positively or negatively can be fixed to the surface of the carrier, as in the case of the binder-type carrier. The charging characteristics, such as polarity, of the coated-type carrier can be adjusted by selecting the kind of the surface coating layer and the electrostatic charging particles. As the coating resin, it is possible to use resins similar to the binder resins for the binder-type carrier.

The mixture ratio of the toner and the carrier of the developer-tank-contained developer 3 is adjusted such that a desired toner charging amount is obtained. The ratio of the toner in the developer-tank-contained developer 3 is preferably 3 to 20 wt % and further preferably 4 to 15 wt % with respect to the total amount of the toner and the carrier. In addition, the replenishment developer 2 stored in the developer replenishing tank 80 contains toner and a small amount of carrier, and the ratio of the carrier in the replenishment developer 2 is preferably 1 to 50 wt % and further preferably 5 to 30 wt %.

The operation of the developing apparatus 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed between the first conveying passage 68 and the second conveying passage 70. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer tank-contained developer 3 charged as described above is supplied to the developing roller 48 in the process of being conveyed to the second conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the second conveying passage 70 of the developer tank 66, and then recovered into the developer tank 66. The recovered developer is mixed with the developer-tank-contained developer 3 that is being conveyed to the second conveying passage 70.

When the toner contained in the developer-tank-contained developer 3 is consumed by the image formation described above, the amount of the toner corresponding to the consumed amount is replenished to the developer-tank-contained developer 3. For this purpose, the developing apparatus 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the first conveying passage 68.

Figure 4:
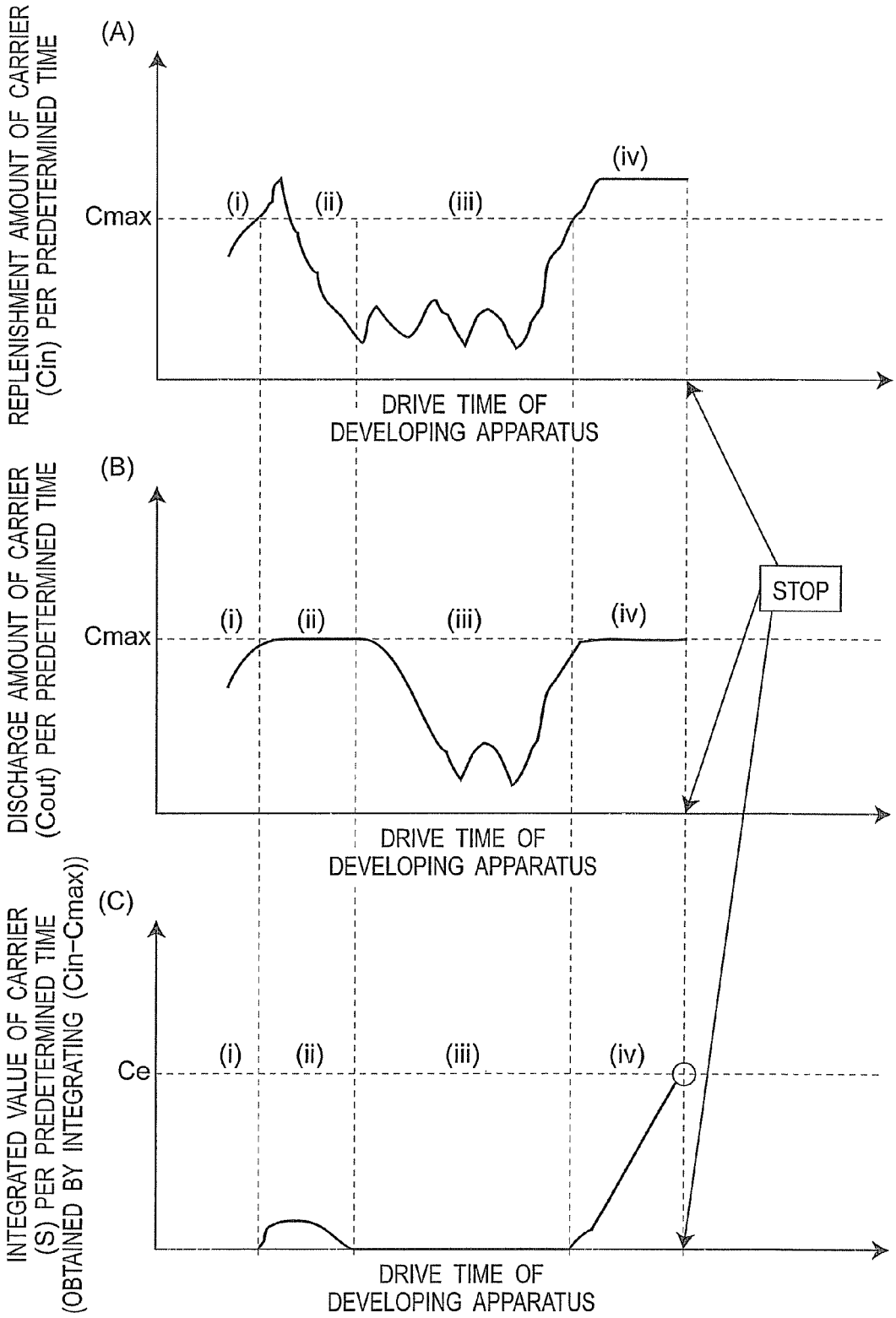
FIGS. 4(A), 4(B) and 4(C) are views schematically showing how the amount of carrier inside the developer tank is changed when various operations are carried out.
Figure 5:
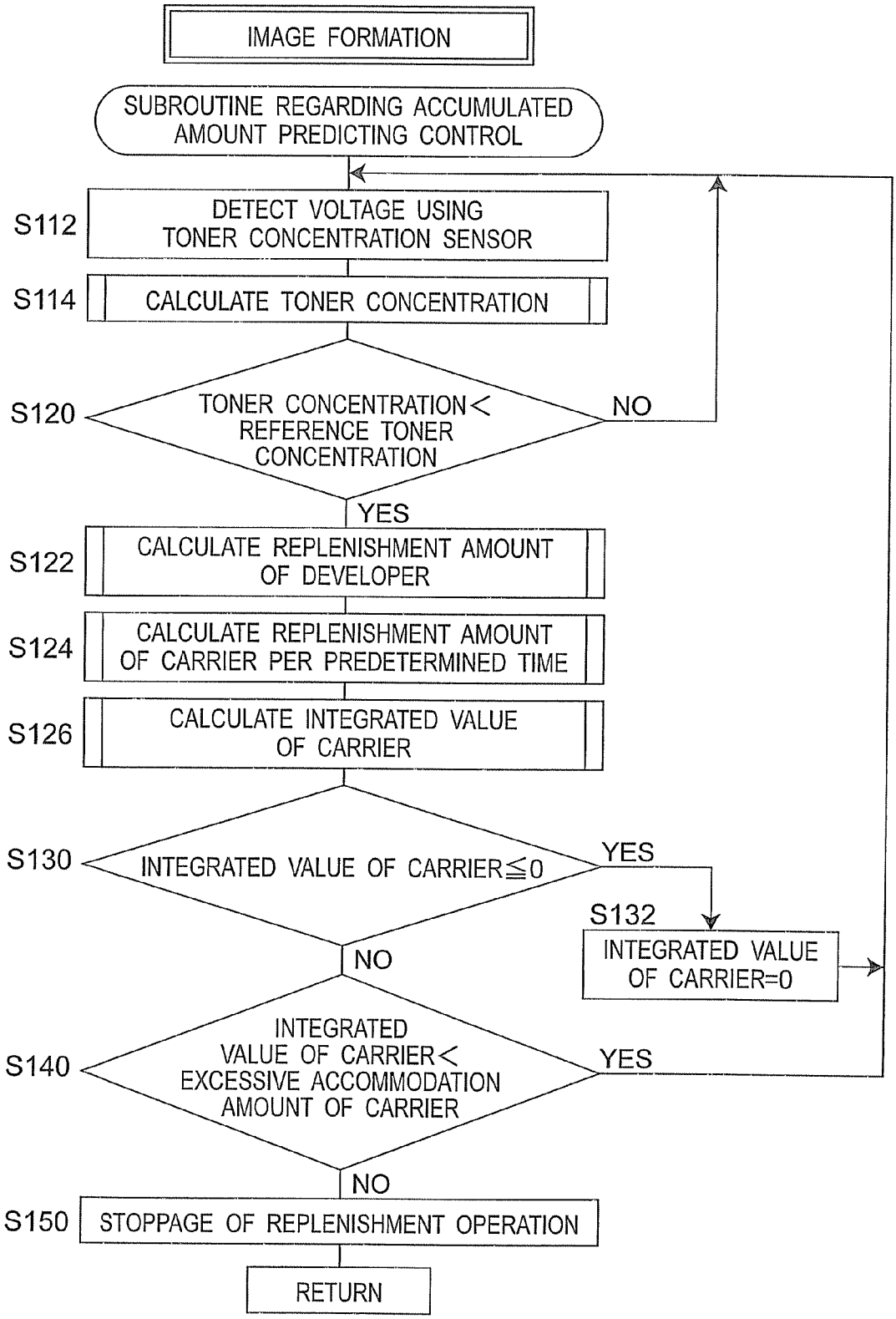
FIG. 5 is a flowchart of a subroutine regarding accumulated amount predicting control according to the first embodiment.

Next, the operation of the developing apparatus 34 according to the first embodiment will be described referring to FIGS. 4 and 5.

FIGS. 4(A), 4(B) and 4(C) are views schematically showing how the amount of carrier inside the developer tank 66 is changed. FIG. 4(A) relates to the replenishment operation, FIG. 4(B) relates to the discharging operation, and FIG. 4(C) relates to the integrating operation. FIG. 5 is a flowchart of a subroutine regarding accumulated amount predicting control according to the first embodiment.

FIG. 4(A) schematically shows how the amount of the carrier contained in the replenishment developer 2 to be replenished from the developer replenishing tank 80 to the developer tank 66 (the replenishment amount of carrier: Cin) is changed with time. In FIG. 4(A), the horizontal axis represents the drive time of the developing apparatus 34, and the vertical axis represents the replenishment amount of carrier (Cin) per predetermined time. Cmax is the maximum discharging amount of carrier discharged to the maximum extent using the trickle discharging mechanism per predetermined time.

Furthermore, FIG. 4(B) schematically shows how the amount of the carrier contained in the developer-tank-contained developer 3 to be discharged outside the developer tank 66 using the trickle discharging mechanism (the discharge amount of carrier: Cout) is changed with time. In FIG. 4(B), the horizontal axis represents the drive time of the developing apparatus 34, and the vertical axis represents the discharge amount of carrier (Cout) per predetermined time. Cmax is the maximum discharging amount of carrier discharged to the maximum extent using the trickle discharging mechanism per predetermined time.

Moreover, FIG. 4(C) schematically shows how the integrated value of carrier (S) obtained by integrating the remaining amount of carrier (Cin−Cmax) remaining inside the developer tank 66 per predetermined time is changed with time. In FIG. 4(C), the horizontal axis represents the drive time of the developing apparatus 34, and the vertical axis represents the integrated value of carrier (S) per predetermined time. Ce is an excessive accommodation amount of carrier obtained by subtracting the full charging amount of the developer-tank-contained developer 3 at which the developer fills the developer tank 66 to the level immediately before the developer is discharged using the trickle discharging mechanism from the overflow limit amount immediately before the developer-tank-contained developer 3 overflows over the regulating gap 63.

When the toner concentration inside the developer tank 66 lowers, the amount of the replenishment developer 2 calculated on the basis of the concentration difference between the current toner concentration of the developer-tank-contained developer 3 and the reference toner concentration and the ratio of the carrier in the replenishment developer 2 is replenished from the developer replenishing tank 80 to the developer tank 66. The amount of the carrier contained in the replenishment developer 2 having been replenished, that is, the replenishment amount of carrier (Cin) is calculated from the ratio of the carrier in the replenishment developer 2 inside the developer replenishing tank 80. Hence, when the toner concentration inside the developer tank 66 is changed, the replenishment amount of carrier (Cin) is changed as shown in FIG. 4(A).

If the replenishment amount of carrier (Cin) is less than the maximum discharge amount of carrier (Cmax) as shown in the region (i) of FIG. 4(A), carrier is discharged from the cutout (outlet) 75 of the trickle discharging mechanism as shown in the region (i) of FIG. 4(B) in a state in which the discharge amount of carrier (Cout) is approximate to the replenishment amount of carrier (Cin). Hence, the relationship that the discharge amount of carrier is nearly equal to the replenishment amount of carrier is established, and no carrier remains in the extra space inside the developer tank 66. The integrated value of carrier (S) is thus set to zero as shown in the region (i) of FIG. 4(C).

When the replenishment amount of carrier (Cin) temporarily becomes more than the maximum discharge amount of carrier (Cmax) as shown in the peak portion on the left side of the region (ii) of FIG. 4(A), carrier is discharged from the cutout (outlet) 75 of the trickle discharging mechanism as shown in the region (ii) of FIG. 4(B) in a state in which the discharge amount of carrier (Cout) is substantially equal to the maximum discharge amount of carrier (Cmax). Then, The amount of the carrier exceeding the maximum discharge amount of carrier (Cmax) remains inside the developer tank 66 without being discharged from the cutout (outlet) 75 of the trickle discharging mechanism. The integrated value of carrier (S) obtained by integrating the amount of the carrier remaining inside the developer tank 66, that is, the remaining amount of carrier (Cin-Cmax), is changed while having a certain range of values.

Since the replenishment amount of carrier (Cin) is less than the maximum discharge amount of carrier (Cmax) on the right side of the peak portion in the region (ii) of FIG. 4(A), the discharge amount of carrier (Cout) is supposed to be substantially equal to the maximum discharge amount of carrier (Cmax). However, since the amount discharged using the trickle discharging mechanism is set lower so as to print out images having ordinary low coverage ratios, carrier discharge using the trickle discharging mechanism is not carried out sufficiently. As a result, a time lag occurs between carrier replenishment and discharge. For this reason, even after the replenishment amount of carrier (Cin) has become more than the maximum discharge amount of carrier (Cmax) (the amount at the peak portion in the region (ii) of FIG. 4(A)), carrier remains inside the developer tank 66. Hence, carrier is discharged from the cutout (outlet) 75 of the trickle discharging mechanism in a state in which the discharge amount of carrier (Cout) remains substantially equal to the maximum discharge amount of carrier (Cmax) for a while.

Since the replenishment amount of carrier (Cin) is less than the maximum discharge amount of carrier (Cmax) in the region (iii) of FIG. 4(A), carrier is discharged in a state in which the discharge amount of carrier (Cout) remains less than the maximum discharge amount of carrier (Cmax) as shown in the region (iii) of FIG. 4(B). When carrier is discharged in the state in which the discharge amount of carrier (Cout) remains less than the maximum discharge amount of carrier (Cmax), the integrated value of carrier (S) is set to zero as shown in the region (iii) of FIG. 4(C).

The region (iv) of FIG. 4(A) shows a state in which developer replenishment, that is, carrier replenishment, is being carried out since images having high coverage ratios, such as photographic images, were begun to be printed out, images having high coverage ratios were then printed out continuously, and the toner inside the developing apparatus was consumed abundantly. Since the replenishment amount of carrier (Cin) is more than the maximum discharge amount of carrier (Cmax), carrier is discharged in a state in which the discharge amount of carrier (Cout) remains substantially equal to the maximum discharge amount of carrier (Cmax) per predetermined time as shown in the region (iv) of FIG. 4(B). The amount of the carrier exceeding the maximum discharge amount of carrier (Cmax) remains inside the developer tank 66. Until the integrated value of carrier (S) obtained by integrating the amount of the carrier remaining inside the developer tank 66, that is, the remaining amount of carrier (Cin−Cmax), reaches the excessive accommodation amount of carrier (Ce), carrier is accommodated in the extra space inside the developer tank 66. However, when the integrated value of carrier (S) reaches the excessive accommodation amount of carrier (Ce), a dangerous state occurs in which the developer-tank-contained developer 3 may overflow over the regulating gap 63. Therefore, appropriate danger avoiding operations, such as the stoppage of replenishment operation for the replenishment developer 2, the stoppage of image forming operation and the execution of forced discharging operation, are carried out.

Next, accumulated amount predicting control according to the first embodiment of the present invention will be described below referring to FIG. 5. While this subroutine is executed, images having high coverage ratios are being printed out continuously.

At step S112, a voltage signal regarding the current toner concentration of the developer-tank-contained developer 3 existing in the developer stirring and conveying chamber 67 is output from the toner concentration detecting sensor 78. At step S114, the output voltage signal is converted by calculation into the value of the current toner concentration using the controller 100.

At step S120, a judgment is made as to whether the current toner concentration is lower than the reference toner concentration. In the case that the current toner concentration is higher than the reference toner concentration and NO is selected, the process returns to step S112 for the measurement of the current toner concentration.

In the case that the current toner concentration is lower than the reference toner concentration at step S120, YES is selected. At step S122, the replenishment amount of the replenishment developer 2 is calculated on the basis of the concentration difference between the current toner concentration detected using the toner concentration detecting sensor 78 and the reference toner concentration and the ratio of the carrier in the replenishment developer 2. A predetermined amount of the replenishment developer 2 is then replenished.

At step S124, the replenishment amount of carrier (Cin) per predetermined time is calculated on the basis of the replenishment amount of the replenishment developer 2 calculated at step S122 and the ratio of the carrier in the replenishment developer 2.

At step S126, the remaining amount of carrier (Cin−Cmax) is calculated by subtracting the maximum discharge amount of carrier (Cmax) discharged to the maximum extent per predetermined time using the trickle discharging mechanism from the replenishment amount of carrier (Cin) per predetermined time, and the integrated value of carrier (S) is then calculated by integrating the remaining amount of carrier (Cin−Cmax).

At step S130, a judgment is made as to whether the integrated value of carrier (S) is not more than zero. In the case that the integrated value of carrier (S) is not more than zero and YES is selected, the process advances to step S132. The integrated value of carrier (S) is set to zero, and the process returns to step S112 for the measurement of the current toner concentration.

In the case that the integrated value of carrier (S) is more than zero at step 130 and NO is selected, the process advances to step S140. At step S140, a judgment is made as to whether the integrated value of carrier (S) is smaller than the excessive accommodation amount of carrier (Ce). In the case that the integrated value of carrier (S) is smaller than the excessive accommodation amount of carrier (Ce) and YES is selected, the process returns to step S112 for the measurement of the current toner concentration.

At step S140, if the integrated value of carrier (S) is larger than the excessive accommodation amount of carrier (Ce), it is predicted that the amount of the developer-tank-contained developer 3 has reached the overflow limit amount immediately before the developer-tank-contained developer 3 overflows over the regulating gap 63 of the developer tank 66. NO is thus selected, and the process advances to step S150. At step S150, the replenishment operation for replenishing the replenishment developer 2 to the developer tank 66 is stopped. The subroutine regarding the accumulated amount predicting control according to the first embodiment is then completed, and the process returns to the main routine. Since this routine is repeated, the replenishment of the replenishment developer 2 is stopped until the developer 3 is discharged and the integrated value of carrier (S) becomes less than the excessive accommodation amount of carrier (Ce). Since the developing apparatus 34 is driven during image formation, the developer 3 inside the developer tank 66 is gradually discharged during image formation as the first screw 72 and the second screw 74 are rotated. When the integrated value of carrier (S) becomes less than the excessive accommodation amount of carrier (Ce), YES is selected at step S130, and the developing apparatus 34 returns to its normal state.

Since the accumulated amount predicting control according to the first embodiment described above is carried out, it is possible to predict how much carrier is accumulated inside the developer tank 66 beyond the discharge level of the trickle discharging mechanism using a very simple structure and at low cost.

Figure 6:
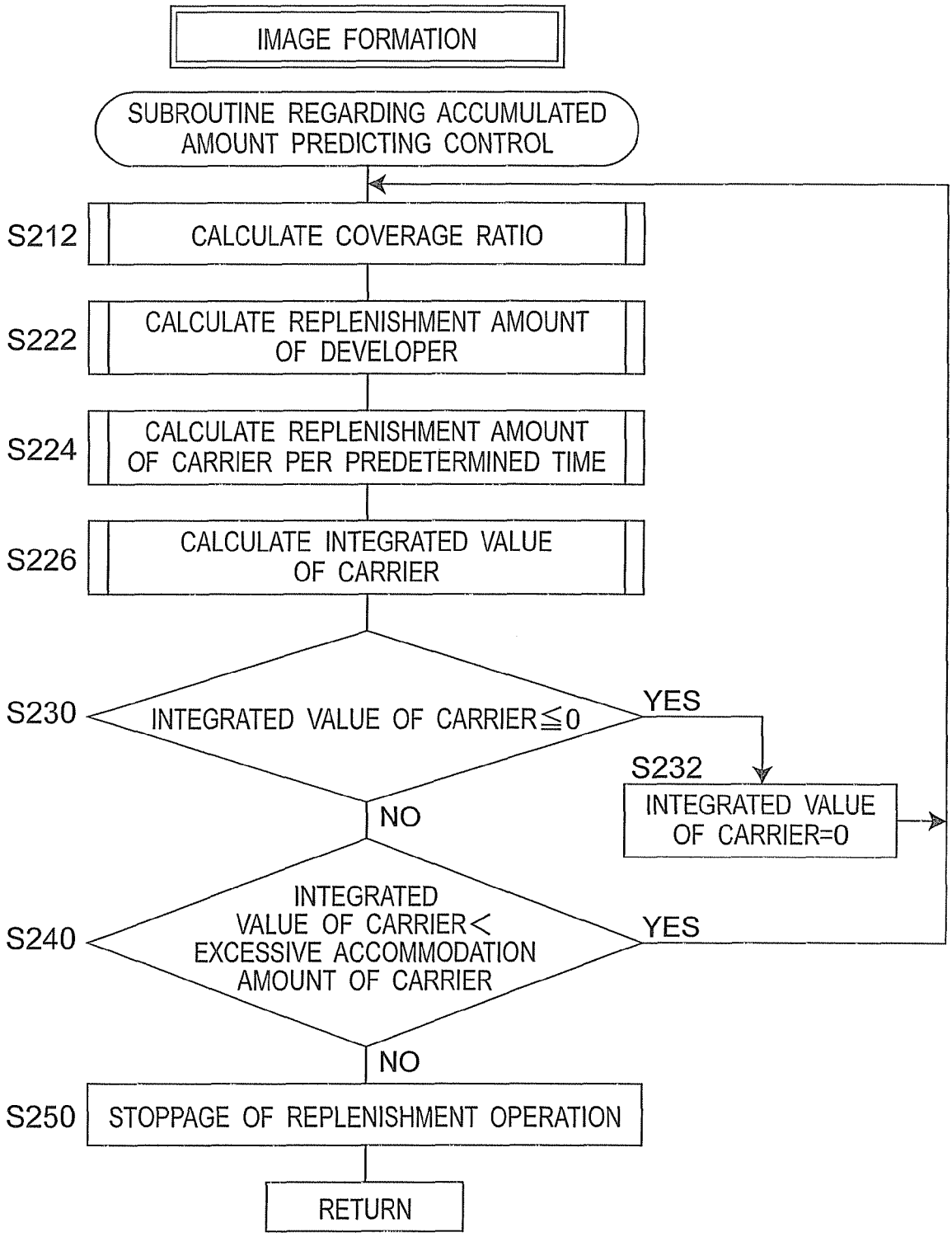
FIG. 6 is a flowchart of a subroutine regarding accumulated amount predicting control according to the second embodiment.

Next, accumulated amount predicting control according to a second embodiment will be described below referring to FIGS. 4 and 6. FIG. 6 is a flowchart of a subroutine regarding the accumulated amount predicting control according to the second embodiment. While this subroutine is executed, images having high coverage ratios are printed out continuously. In this embodiment, descriptions common to those for the above-mentioned first embodiment are omitted, and differences from the first embodiment will be described mainly.

When images having high coverage ratios are printed out, the amount of the replenishment developer 2 calculated on the basis of the coverage ratio (dot counter) during image formation, the number of images having high coverage ratios and being formed and the ratio of the carrier in the replenishment developer 2 is replenished from the developer replenishing tank 80 to the developer tank 66. The amount of the carrier contained in the replenished replenishment developer 2, i.e., the replenishment amount of carrier (Cin), is calculated on the basis of the ratio of the carrier in the replenishment developer 2 inside the developer replenishing tank 80. Hence, if the toner concentration inside the developer tank 66 is changed, the replenishment amount of carrier (Cin) is changed as shown in FIG. 4(A).

At step S212, the coverage ratio is calculated by integrating the total area of images on the basis of the image size information for each predetermined number of images or by integrating the data of images formed on the total area. For example, if the coverage ratio is approximately 5%, the data is mainly text data. If the coverage ratio is approximately 70% or more, the data is mainly image data, such as photographic data, and it is assumed that images having high coverage ratios are formed.

It is possible to estimate how much toner has been consumed depending on the calculated coverage ratio. Hence, at step S222, the replenishment amount of the replenishment developer 2 is calculated on the basis of the calculated consumed amount of toner and the ratio of the carrier in the replenishment developer 2. A predetermined amount the replenishment developer 2 is then replenished.

At step S224, the replenishment amount of carrier (Cin) per predetermined time is calculated on the basis of the replenishment amount of the replenishment developer 2 calculated at step S222 and the ratio of the carrier in the replenishment developer 2.

At step S226, the remaining amount of carrier (Cin−Cmax) is calculated by subtracting the maximum discharge amount of carrier (Cmax) discharged to the maximum extent per predetermined time using the trickle discharging mechanism from the replenishment amount of carrier (Cin) per predetermined time, and the integrated value of carrier (S) is then calculated by integrating the remaining amount of carrier (Cin−Cmax).

At step S230, a judgment is made as to whether the integrated value of carrier (S) is not more than zero. In the case that the integrated value of carrier (S) is not more than zero and YES is selected, the process advances to step S232. The integrated value of carrier (S) is set to zero, and the process returns to step S212 for the coverage ratio calculation operation.

In the case that the integrated value of carrier (S) is more than zero at step 230 and NO is selected, the process advances to step S240. At step S240, a judgment is made as to whether the integrated value of carrier (S) is smaller than the excessive accommodation amount of carrier (Ce). In the case that the integrated value of carrier (S) is smaller than the excessive accommodation amount of carrier (Ce) and YES is selected, the process returns to step S212 for the coverage ratio calculation operation.

At step S240, if the integrated value of carrier (S) is larger than the excessive accommodation amount of carrier (Ce), it is predicted that the amount of the developer-tank-contained developer 3 has reached the overflow limit amount immediately before the developer-tank-contained developer 3 overflows over the regulating gap 63 of the developer tank 66. NO is thus selected, and the process advances to step S250. Just as an example, the amount of the developer is designed to reach the overflow limit amount when 50 to 100 images having high coverage ratios of approximately 70% or more are printed out continuously, although the amount is different depending on the excessive accommodation amount of carrier (Ce) serving as a design factor of the developing apparatus 34. At step S250, the replenishment operation for replenishing the replenishment developer 2 to the developer tank 66 is stopped. The subroutine regarding the accumulated amount predicting control according to the second embodiment is then completed, and the process returns to the main routine.

Since the accumulated amount predicting control according to the second embodiment described above is carried out, it is possible to predict how much carrier is accumulated inside the developer tank 66 beyond the discharge level of the trickle discharging mechanism using a very simple structure and at low cost.

Although the above description is given using specific embodiments in the above-mentioned respective embodiments, the present invention is not restricted by the embodiments but can be modified variously without departing from the scope defined in the appended claims and equivalents thereof.

In the above-mentioned respective embodiments, in the case that it has been judged that the integrated value of carrier (S) is larger than the excessive accommodation amount of carrier (Ce), the replenishment operation is stopped. However, instead of the stoppage of the replenishment operation or together with the stoppage of the replenishment operation, it is also possible to forcibly discharge the developer-tank-contained developer 3 by rotating the stirring members 72 and 74 of the developing apparatus 34 or to stop the image forming operation or to carry out alarming operation (indicating alarm on a display or generating alarm sound).

Furthermore, in the above-mentioned embodiments, the consumed amount of toner is calculated to calculate the replenishment amount of the replenishment developer 2. The toner concentration is used in the above-mentioned first embodiment and the coverage ratio is used in the above-mentioned second embodiment to calculate the consumed amount of toner. However, it is also possible to use the toner concentration and the coverage ratio in combination.

What is claimed is:

1. A developing apparatus having stirring members for stirring a developer-tank-contained developer containing toner and carrier inside a developer tank while conveying the developer and a developer holder disposed adjacent to said stirring members to supply the stirred developer-tank-contained developer to an electrostatic latent image holder, comprising:

a developer replenishing tank for replenishing the toner and the carrier to said developer tank, a discharging mechanism provided in said developer tank to discharge an excessive amount of the developer-tank-contained developer outside said developer tank when the amount of the developer-tank-contained developer inside said developer tank has exceeded a predetermined amount, calculating device for calculating the amount of the carrier existing inside said developer tank, wherein said calculating device judges whether the integrated value of carrier obtained by integrating the carrier existing inside said developer tank is likely to exceed a predetermined excessive accommodation amount of carrier.

2. The developing apparatus according to claim 1, wherein in the case that it is defined that the replenishment amount of carrier to be replenished from said developer replenishing tank per predetermined time is Cin and that the maximum discharge amount of carrier to be discharged to the maximum extent using said discharging mechanism per predetermined time is Cmax, said calculating device calculates the remaining amount of carrier (Cin−Cmax) remaining inside said developer tank per predetermined time and calculates the integrated value of carrier by integrating the calculated remaining amount of carrier (Cin−Cmax).

3. The developing apparatus according to claim 2, wherein the replenishment amount of carrier is calculated on the basis of toner concentration.

4. The developing apparatus according to claim 2, wherein the replenishment amount of carrier is calculated on the basis of coverage ratio.

5. The developing apparatus according to claim 1, wherein the replenishment of toner and carrier to said developer tank is stopped in the case that it has been judged using said calculating device that the integrated value of carrier is likely to exceed the predetermined excessive accommodation amount of carrier.

6. The developing apparatus according to claim 5, wherein the replenishment of replenishment developer is stopped until it is judged using said calculating device that the integrated value of carrier is less than the excessive accommodation amount of carrier.

7. An image forming machine having a rotatable electrostatic latent image holder for holding electrostatic latent images on the circumferential face thereof, stirring members for stirring a developer-tank-contained developer containing toner and carrier inside a developer tank while conveying the developer, and a developer holder disposed adjacent to said stirring members to supply the stirred developer-tank-contained developer to said electrostatic latent image holder, comprising:

a developer replenishing tank for replenishing the toner and the carrier to said developer tank, a discharging mechanism provided in said developer tank to discharge an excessive amount of the developer-tank-contained developer outside said developer tank when the amount of the developer-tank-contained developer inside said developer tank has exceeded a predetermined amount, calculating device for calculating the amount of the carrier existing inside said developer tank, wherein said calculating device judges whether the integrated value of carrier obtained by integrating the carrier existing inside said developer tank is likely to exceed a predetermined excessive accommodation amount of carrier.

8. The image forming machine according to claim 7, wherein in the case that it is defined that the replenishment amount of carrier to be replenished from said developer replenishing tank per predetermined time is Cin and that the maximum discharge amount of carrier to be discharged to the maximum extent using said discharging mechanism per predetermined time is Cmax, said calculating device calculates the remaining amount of carrier (Cin−Cmax) remaining inside said developer tank per predetermined time and calculates the integrated value of carrier by integrating the calculated remaining amount of carrier (Cin−Cmax).

9. The image forming machine according to claim 8, wherein the replenishment amount of carrier is calculated on the basis of toner concentration.

10. The image forming machine according to claim 8, wherein the replenishment amount of carrier is calculated on the basis of coverage ratio.

11. The image forming machine according to claim 7, wherein the replenishment of toner and carrier to said developer tank is stopped in the case that it has been judged using said calculating device that the integrated value of carrier is likely to exceed the predetermined excessive accommodation amount of carrier.

12. The image forming machine according to claim 11, wherein the replenishment of replenishment developer is stopped until it is judged using said calculating device that the integrated value of carrier is less than the excessive accommodation amount of carrier.

13. A developer amount predicting method applied to a developing apparatus having stirring members for stirring a developer-tank-contained developer containing toner and carrier inside a developer tank while conveying the developer and a developer holder disposed adjacent to said stirring members to supply the stirred developer-tank-contained developer to an electrostatic latent image holder, a developer replenishing tank for replenishing the toner and the carrier to said developer tank, a discharging mechanism provided in said developer tank to discharge an excessive amount of the developer-tank-contained developer outside said developer tank when the amount of the developer-tank-contained developer inside said developer tank has exceeded a predetermined amount, and calculating device for calculating the amount of the carrier existing inside the developer tank, comprising the steps of:

calculating the amount of developer to be replenished on the basis of the consumed amount of toner, calculating the amount of carrier to be replenished per predetermined time on the basis of the amount of developer to be replenished, calculating the integrated value of carrier obtained by integrating the remaining amount of carrier obtained by subtracting the maximum discharge amount of carrier discharged to the maximum extent per predetermined time using said discharging mechanism from the replenishment amount of carrier, and judging whether the integrated value of carrier has exceeded a predetermined excessive accommodation amount of carrier.

14. The method according to claim 13, wherein the replenishment amount of carrier is calculated on the basis of toner concentration.

15. The method according to claim 13, wherein the replenishment amount of carrier is calculated on the basis of coverage ratio.

16. The method according to claim 13, wherein the replenishment of toner and carrier to said developer tank is stopped in the case that it has been judged using said calculating device that the integrated value of carrier is likely to exceed the predetermined excessive accommodation amount of carrier.

17. The method according to claim 16, wherein the replenishment of replenishment developer is stopped until it is judged using said calculating device that the integrated value of carrier is less than the excessive accommodation amount of carrier.

18. The developing apparatus according to claim 1, wherein the predetermined amount is different than the excessive accommodation amount of carrier.

19. The image forming machine according to claim 7, wherein the predetermined amount is different than the excessive accommodation amount of carrier.

20. The method according to claim 13, wherein the predetermined amount is different than the excessive accommodation amount of carrier.

* * * * *